United States Patent [19]

Autry

[11] Patent Number: 4,624,062

[45] Date of Patent: Nov. 25, 1986

[54] SOLE WITH CUSHIONING AND BRAKING SPIROIDAL CONTACT SURFACES

[75] Inventor: James C. Autry, Dallas, Tex.

[73] Assignee: Autry Industries, Inc., Dallas, Tex.

[21] Appl. No.: 745,709

[22] Filed: Jun. 17, 1985

[51] Int. Cl.[4] ..... A43B 13/00; A43B 13/04

[52] U.S. Cl. ..... 36/114; 36/28; 36/32 R; 36/59 C; D2/320

[58] Field of Search ..... D2/320; 36/59 R, 59 C, 36/114, 103, 32 R, 28, 29, 7.6, 7.7, 25

[56] References Cited

U.S. PATENT DOCUMENTS

| | | | |
|---|---|---|---|
| D. 39,747 | 1/1909 | McKenna | D2/320 |
| D. 201,952 | 8/1965 | Johns | D2/320 |
| D. 259,595 | 6/1981 | Famolare, Jr. | D2/320 |
| 1,552,022 | 9/1925 | Willson | 36/59 C |
| 2,155,166 | 4/1939 | Kraft | 36/59 C |
| 2,421,932 | 6/1947 | Goldstein | 36/25 |
| 4,329,790 | 5/1982 | Bell | 36/59 C |
| 4,571,852 | 2/1986 | Lamarche et al. | 36/59 C |

FOREIGN PATENT DOCUMENTS

| | | | |
|---|---|---|---|
| 325372 | 12/1918 | Fed. Rep. of Germany | 36/59 R |
| 3035706 | 6/1982 | Fed. Rep. of Germany | 36/59 C |
| 254536 | 8/1927 | Italy | 36/59 C |

*Primary Examiner*—Werner H. Schroeder

*Assistant Examiner*—Steven N. Meyers

*Attorney, Agent, or Firm*—Jerry W. Mills; Gregory M. Howison

[57] ABSTRACT

A sole (12) for an athletic shoe (10) includes a base member (42) having a main lower surface (22). A contact surface (26) extends downwardly from the base member (42) to below the main lower surface (22) in order to contact the ground or floor before the main lower surface (22) as the shoe (10) descends. The contact surface (26) includes a horizontally elongate, resiliently flexible spiroidal member (38). The spiroidal member (38) has a plurality of involutions (56). Each involution (56) has a plurality of longitudinal portions (52–54) and a plurality of transverse portions (48–50). Portions (48–54) have flat bottom surfaces (30) for frictionally gripping the ground or floor disposed opposite the portions' attachments (96) to base member (42). Portions (48–54) provide a braking, shock-absorbing and anti-slipping action in response to horizontal shear forces normal to them. In a preferred embodiment, contact surface (26) includes an endless member (34) that aids in entrapping a cushion of air upon downward force being exerted by the wearer's foot on the floor or ground. In a preferred embodiment, both a plantar contact surface (26) and a heel contact surface (28) are provided.

17 Claims, 6 Drawing Figures

SOLE WITH CUSHIONING AND BRAKING SPIROIDAL CONTACT SURFACES

TECHNICAL FIELD OF THE INVENTION

This invention relates in general to soles for athletic or other active-wear shoes and more particularly relates to contact surfaces for cushioning the wearer's foot upon impact with the ground or floor and for providing braking action upon the imposition of a shear force on the sole.

BACKGROUND OF THE INVENTION

When running in athletic and other active-wear shoes, very high downward forces are often exerted on the runner's foot which must be cushioned. Such athletic shoes generally have a fairly tough, nonyielding tread made out of a material such as rubber. The conventional solution toward providing cushioning for the foot has been to provide an insole on top of the rubber tread. Such an insole usually distributes cushioning material uniformly on top of the sole, whereas the downward force exerted by the foot on the ground or floor is generally concentrated in the plantar and heel areas of the foot. Insofar as such a uniformly cushioning insole provides a cushioning of relatively hard footfalls, it also continues to cushion the foot after the downward force above the normal gravitational force has been dissipated. This continued overcushioning reduces the "feel" of the foot for the surface. Finally, even where an insole has been provided in conventional constructions, it still may be inadequate to shield the foot from impact due to large downward forces of the foot on the ground or floor.

Previous cushioning techniques have incorporated concentric rings or grooves formed on the bottom of the shoe soles. However, such rings or grooves are independent of one another, and a cushioning effect provided by one ring or groove does not necessarily affect adjacent rings or grooves.

Another problem often encountered in athletic activities is the limited ability of the shoe to resist forward, backward, rightward or leftward shear forces without slipping. In such sports as basketball or tennis, the wearer is often required to quickly change the direction of his motion or to halt altogether. This imposes a large shear force on the sole, which causes the foot to be prone to slipping out from under the wearer. In instances where the sole is successful in continuing to grip the surface, the sudden shear force often causes dislocation, sprain or like injury to the foot, ankle or leg.

A need therefore exists for a sole for an athletic or active-wear shoe which includes means for specifically cushioning the plantar and heel surfaces of the foot against hard footfalls. Further, a need exists for an athletic or activewear shoe with a sole that exhibits enhanced frictional force against shear forces and that at the same time acts to provide a non-slipping, braking, force-absorbing action.

SUMMARY OF THE INVENTION

The present invention disclosed and claimed herein provides a sole for an athletic or other active-wear shoe. The sole has a base with a main tread that defines a main lower surface. A contact surface is attached to the base. The contact surface extends downwardly from the base to a point below the main lower surface. As the shoe discends toward the ground or floor, the contact surface will contact the ground before the main lower surface.

The contact surface includes an elongate, resiliently flexible spiroidal member having a plurality of involutions or spires. The spiroidal member includes a plurality of longitudinal portions and a plurality of transverse portions. The longitudinal and transverse portions each have bottom surfaces for frictionally gripping the ground or floor. The longitudinal portions, upon downward force being exerted by the wearer on the floor or ground, and upon rightward or leftward shear force being exerted on the sole, elastically bend and stretch between their bottom surfaces and their points of attachment in a direction opposite the shear force. In this manner, the longitudinal portions provide a braking, antiskidding and force-absorbing action. Each of the transverse portions act in a similar manner when a frontward or rearward shear force is exerted on the sole.

Preferably, the contact surface also includes an endless member that is circumferentially disposed horizontally around the spiroidal member. The endless member is resiliently flexible and extends downwardly from the base to below the main lower surface in a manner similar to the spiroidal member. Both the spiroidal member and the endless member deform to provide cushioning against impact upon exertion of downward force by the wearer's foot on the ground or floor. In addition, the endless member makes sealing contact with the ground or floor in order to entrap a cushion of air, thereby further acting to cushion against impact between the wearer's foot and the ground or floor.

In a preferred embodiment, one contact surface is disposed beneath the plantar area of the wearer's foot, and a second contact surface is disposed beneath the heel. Each contact surface is preferably integrally formed with the sole out of natural rubber.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
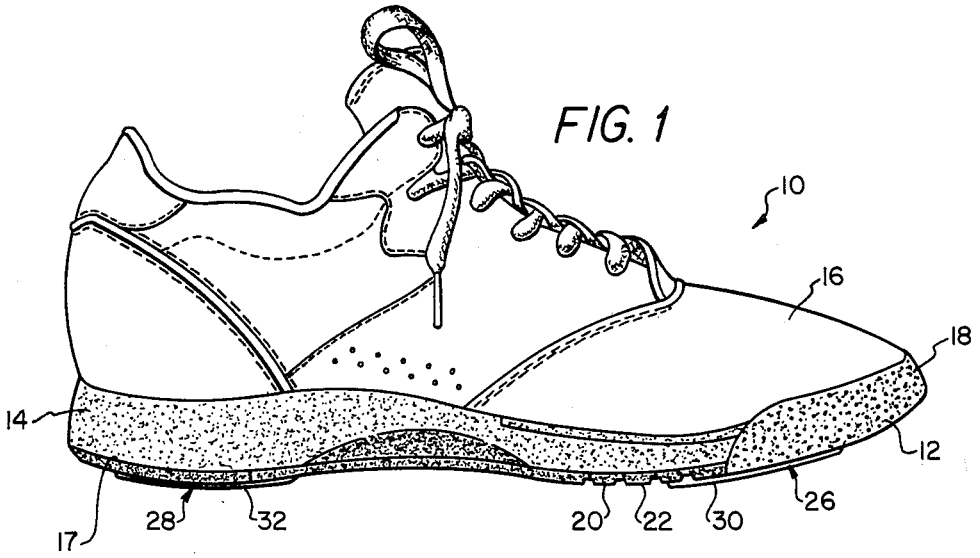
FIG. 1 is an elevation of an athletic shoe employing the sole of the invention.

Referring to FIG. 1, an athletic shoe 10 has a sole 12, an attached insole 14 and an upper 16. Insole 14 is glued to an upper surface 17 of sole 12, and may be fashioned of a cushionable material such as lhtlon, a type of ethylene vinyl acetate having a higher-than-normal concentration of vinyl and a lower-than-normal concentration of ethylene. Upper 16 can be constructed out of leather or cloth materials. Sole 12 may include an upstanding anti-wear toe portion 18 and has a main tread 20 defining a main lower sole surface 22.

Sole 12 has a plantar contact surface 26 and preferably also has heel contact surface 28. Contact surfaces 26 and 28 are in their preferred form integrally formed with sole 12. Bottom surfaces 30 and 32 of contact surfaces 26 and 28 extend below main sole surface 22. Sole 12 is preferably fabricated out of natural rubber.

Figure 2:
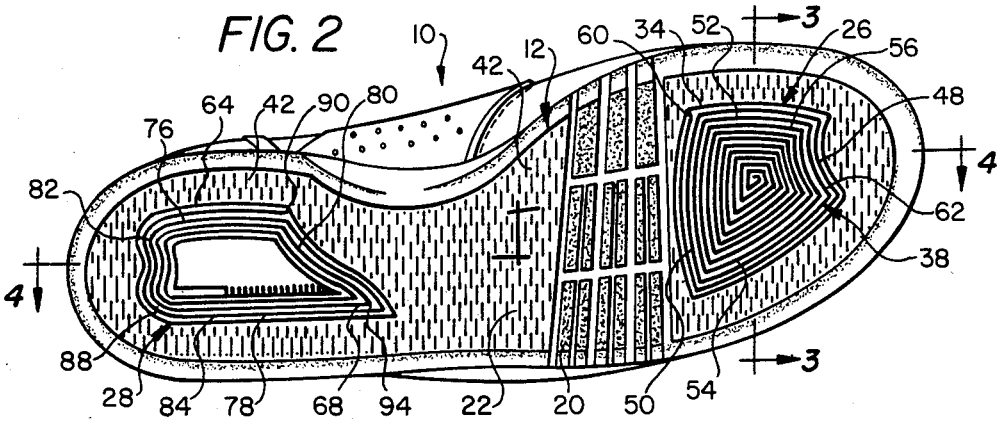
FIG. 2 is a bottom plan view of the sole and shoe shown in FIG. 1.

FIG. 2 best shows the preferred form of the contact surfaces 26 and 28 provided by the invention. Plantar contact surface 26 includes an outer endless member 34, and a spirodidal member 38 disposed inwardly of endless member 34. Spiroidal member 38 spirals inward toward the center of contact surface 26, and outer endless member 34 forms the outer margin thereof. Endless member 34 and spirodial member 38 include a plurality of forward portions 48, rearward portions 50, rightward portions 52 and leftward portions 54. Portions 48–54 extend vertically downward from a base member 42 (FIGS. 3 and 4) of sole 12.

The forward portion 48, rearward portion 50, rightward portion 52, and leftward element 54 of endless member 34 are joined end-to-end to form a continuous perimeter.

Spiroidal member 38 a plurality of involutions or spires 56 joined end to end, each involution turning inwardly through 360°. Each involution 56 comprises, after the manner of endless member 34, a forward portion 48, a rearward portion 50, a rightward portion 52 and a leftward portion 54. Except where the outermost of involutions 56 joins endless member 34 at a junction 60, each involution 56 is uniformly spaced from each adjacent involution as well as from endless member 34 by a space 62 of uniform width. The outermost of involutions 56 generally conforms in shape to endless member 34, and successively inward involutions 56 generally conform in shape to the next adjacent outward involution. This arrangement assures that each forward, rearward, rightward, and leftward element 48, 50, 52 and 54 is aligned substantially in parallel with others of like kind.

Endless member 34 and spiroidal member 38 are preferably the only members used to make up plantar contact surface 26, although further members of similar construction could be employed. The exclusive use of endless and spiroidal forms for members 34 and 38 gives plantar contact surface 26 two characteristics. One of these is the entrapment of an air cushion interiorly of endless member 34. When endless member 34 and spiroidal member 38 make sealed contact with the ground or floor, each member tends to entrap an air cushion inside of one or more of the uniform spaces 62. Because member 34 is endless, it leaves no gaps for the cushioning air to escape to the outside. Spiroidal member 38 has only one gap to the exterior at any radius from the center of surface 26, and this further enhances the entrapment action.

The other reason for forming members 34 and 38 after the manner described is to provide the least resistance to yieldable bending and stretching. Each element 48–54, when subjected to a shear force having a component perpendicular to its face, will tend to bend much more readily if there are no reinforcing or intersecting elements than if there are. Since each involution 56 is not joined end-to-end to itself, contact surface 26 has one less point of reinforcement than if a further endless member were substituted in place of the involution. This is why only spiroidal member 38 is used to fill the interior of contact surface 26.

Heel contact surface 28 is similarly constructed. Surface 28 is comprised of an endless member 64 and a spiroidal member 68 inwardly disposed of member 64. Spiroidal member 68 is used in contact surface 28 instead of further endless members because several points of reinforcement are thereby avoided. Members 64 and 68 comprise a series of rightward portions 76, leftward portions 78, frontward portions 80 and rearward portions 82. Like the corresponding member 34 of plantar contact surface 26, endless member 64 of heel contact surface 28 consists of a rightward element 76, a leftward element 78, a frontward element 80 and a rearward element 82 joined end-to-end to form a continuous perimeter. Endless member 64 defines the outer margin of heel contact surface 28. Like endless member 34, endless member 64 acts to entrap cushioning air to enhance the cushioning action of the contact surface.

Spiroidal member 68 is formed in a manner similar to spiroidal member 38 of plantar surface 26. Member 68 comprises a series of involutions 84 joined end to end, each involution turning inwardly through 360°. Each involution 84 includes rightward member 76, leftward member 78, frontward member 80 and rearward member 82. The outermost of involutions 84 closely follows the contour and shape of endless member 64. The outermost of involution 84 is uniformly spaced from endless member 64 by a uniform space 88, except at its junction 90 with endless member 64. Each involution 84 is uniformly spaced by uniform space 88 from each adjacent involution, and generally conforms to the shape of the next adjacent outer involution.

Heel contact surface 28 has an extension 94 on the lateral side of shoe 10 in order to generally conform heel contact surface 28 to the heel contact surface of the wearer's foot.

Plantar surface 26 has substantially more portions 48–54 in its structure than like portions 76–82 in heel contact surface 28. This is because substantially more force is applied to plantar surface 26 than heel contact surface 28 in most situations. Thus, in order to get an even cushioning effect, more portions 48–54 should be employed than portions 76–82. The horizontal shapes of contact surfaces 26 and 28 can be varied away from those shown in FIG. 2, so long as they are underneath the respective plantar and heel surfaces of the foot and generally conform in horizontal extent to those foot surfaces.

Figure 3:
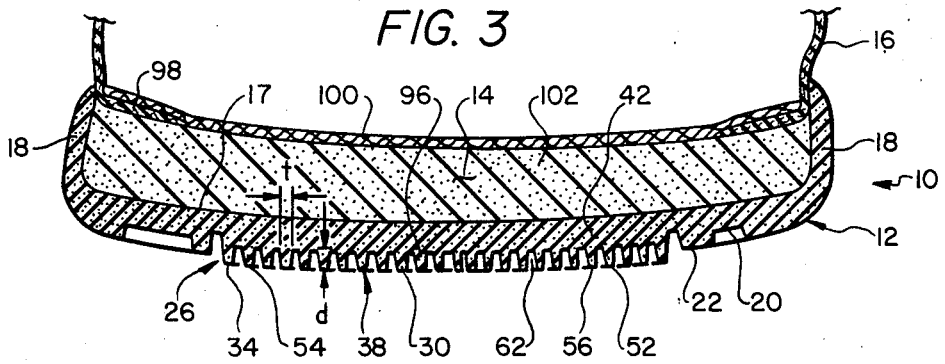
FIG. 3 is a transverse section taken substantially along line 3—3 of FIG. 2, with most of the shoe upper broken away.

FIG. 3 shows a transverse section of plantar contact surface 26. Each portion 48–54 (only rightward and leftward portions 52–54 are shown in this section) extends downwardly to a point substantially below main sole surface 22. Portions 48–54 will thus contact the ground or floor before main surface 22. Portions 48–54 are relatively thin, having a thickness t less than the vertical depth d. This construction aids in the portions' resilient flexibility and elasticity. Portions 76–82 of heel contact surface 28 are similarly constructed.

Uniform space 62 is on the same order of magnitude as thickness t of portions 48'54. Uniform spaces 62 are sized so as to allow a substantial amount of air to be formed in an entrapped air cushion when endless member 34 makes sealed contact with the ground or floor.

Spaces 62 further give room for portions 48–54 to vertically deform, bend and horizontally stretch when the portions make forceable contact with the floor or ground. With the above criteria in mind, uniform spaces 62 are also sized to provide the maximum number of elements in contact surface 26. Each portion 48–54 has bottom surface 30 opposite the portion's attachment 96 to base member 42. Bottom surfaces 30 are flat in order to best frictionally grip the floor, ground or playing surface. Portions 76–82 of heel surface 28 (FIG. 4) are similarly provided with bottom surface 32, and uniform spaces 88 are sized as a result of the same considerations used to size uniform spaces 62.

In this embodiment, insole 14 is attached as by gluing to upper surface 17 of sole 12. In another embodiment (not shown), insole 14 may be inserted into an appropriately dimensioned receptacle inside of a rubber shell including sole 12. Upper 16 has a horizontal lip member 98 disposed for gluing to insole member 14. A leatherized paper texon 100 may be affixed as by gluing across the top of horizontal lip member 98 and insole 14.

Figure 4:
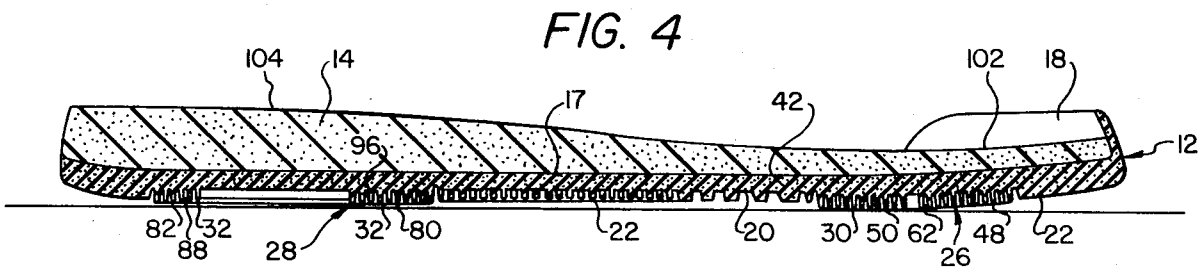
FIG. 4 is a longitudinal section taken substantially along line 4—4 of FIG. 2, showing the sole and insole portion of the shoe only.

FIG. 4 shows a longitudinal section of sole 12, insole 14, contact surface 26 and heel contact surface 28. FIG. 4 illustrates the downward extension of portions 48–50 and 76–78 below main sole or tread surface 22. Substantially more plantar transverse portions 48–50 are used than heel transverse elements 76–78.

Insole 14 is thinner in a front area 102 than in a rear area 104 in order to raise the heel of the wearer's foot above the plantar surface thereof to alleviate stress on the Achilles tendon. More cushioning material is therefore provided at 104 than at 102. The use of correspondingly more contact surface portions 48–54 in plantar contact surface 26 than contact surface portions 76–82 in heel contact surface 28 offsets the difference in thicknesses of insole areas 102 and 104.

Figure 5:
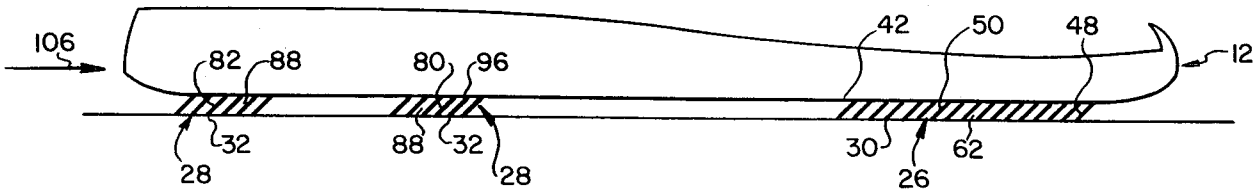
FIG. 5 is a schematic diagram corresponding to the sole section shown in FIG. 4, showing the reaction of the contact surface transverse portions to a shear force from the rear.

FIG. 5 is a schematic diagram corresponding to FIG. 4, showing the braking, force-absorbing and non-skidding effect of portions 48–50 and 76–78 in response to a forward shear force 106. Transverse portions 48–50 and 76–78 all bend rearwardly from their attachments 96, providing a resilient, force-absorbing, braking action. Further, portions 48–50 and 76–80 stretch between their attachments 96 and their bottom surfaces 30 in order to augment the resilient, braking, force-absorbing action. This method of stopping sole 12 provides a less sudden deceleration and therefore causes less shock to the foot. Also, since the grabbing and holding tendency of sole 12 is enhanced by the braking action of portions 48–54 and 76–82, sole 12 has less of a tendency to slip with respect to the playing or running surface.

Figure 6:
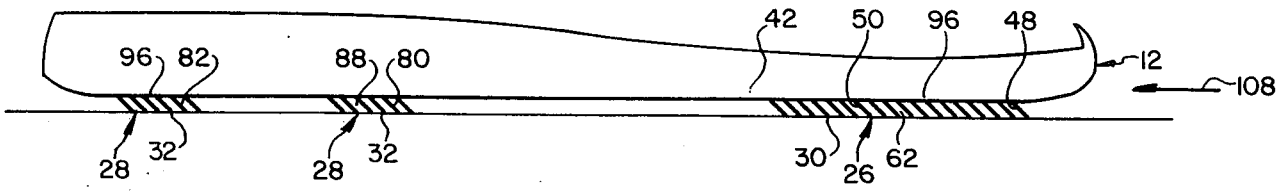
FIG. 6 is a schematic diagram corresponding to the sole section shown in FIG. 4, showing the reaction of the contact surface transverse portions to a shear force from the front.

As shown by FIG. 6, transverse portions 48–50 and 76–82 react in a mirror-image manner to a rearward shear force 108. In this case, transverse portions 48–50 and 76–82 bend frontwardly from their attachments 96, and stretch between their attachments 96 and their bottom, frictionally gripping surfaces 30 and 32. As in the case of resisting a forward shear force, these bending and stretching actions tend to absorb the force of a rearward shear force 108, and produce like braking, non-skidding and shock force absorbing effects.

Longitudinal portions 52–54 and 80–82 (FIGS. 2 and 3) exhibit similar braking, force-absorbing and non-skidding actions when subjected to rightward shear forces or leftward shear forces. Thus, plantar and heel contact surfaces 26 and 28 provide a braking, force-absorbing and anti-skidding action in response to a shear force from any direction.

The invention thus combines two important advances over conventional athletic or active-wear soles. First, the invention provides one or more contact surfaces which each have a downwardly projecting endless member and a downwardly projecting spiroidal member that tend to trap an air cushion upon the application of downward force on the contact surface by the wearer's foot. This aids in the cushioning of initial impact. Second, each contact surface provides a substantially improved braking, force-absorbing and non-skidding action in response to shear forces supplied to the shoe. By using spiroidal members, these actions are enhanced by the avoidance of points of reinforcement in the construction of the contact surfaces.

Although the preferred embodiment has been described in detail, it should be understood that various changes, substitutions and alterations can be made therein without departing from the spirit and scope of the invention as defined by the appended claims.

What is claimed is:

1. A sole for a shoe comprising:

a base member having a lower surface;

a contact surface attached to said base member and extending inwardly from said base member to below said lower surface and disposed to contact the ground or floor before said lower surface makes contact as the shoe descends;

said contact surface including an eloneate, resiliently flexible spiroidal member vertically extending from said base member to below said lower surface, said spiroidal member having a plurality of involutions integral with one another;

at least one endless member disposed horizontally around said spiroidal member, said endless member being resiliently flexible and extending downwardly from said base member to below said lower surface;

said endless member adapted to make sealing contact with the ground or floor in order to entrap cudhioning air, said entrapped air further acting to cushion against impact between the wearer's foot and the ground or floor.

2. The sole of claim 1 wherein said contact surface includes a plantar contact surface disposed beneath the plantar surface of the wearer's foot.

3. The sole of claim 2 wherein said contact surface further includes a heel contact surface disposed beneath the heel surface of the wearer's foot.

4. The sole of claim 2 wherein the area of said plantar contact surface corresponds substantially to the area of the plantar surface of the wearer's foot.

5. The sole of claim 1 wherein said plantar contact surface is integral with said base member.

6. The sole of claim 5 wherein said sole is inteerally formed of rubber.

7. The sole of claim 1 wherein said spiroidal member is of a thickness less than its depth, each said involution being uniformly spaced from each adjacent involution, the space between adjacent involutions being on the same order of magnitude as said spiroidal member's thickness.

8. A sole for a shoe comprising:

a base member having a lower surface;

a contact surface attached to said base member and extending downwardly from said base member to below said lower surface and disposed to contact the ground or floor before said lower surface makes contact as the shoe descends;

said contact surface including an elongate, resiliently flexible spiroidal member vertically extending from said base member to below said lower surface, said spiroidal member having a plurality of involutions integral with one another;

each of said involutions having four discretelv oriented portions joined end to end, at least two of said portions being oriented substantially transverse with respect to the longitudinal axis of said sole and facing frontward or rearward with bottom surfaces for frictionally gripping the floor or ground, said portions of each having an attachment to said base member opposed to said bottom surface;

each of said transverse portions, upon downward force being exerted by the wearer on the floor or ground and upon frontward or rearward shear force being inserted on said sole, elastically bending and stretching between said bottom surface and said attachment in a direction opposite said shear force to provide a braking and antiskidding action.

9. The sole of claim 8 wherein said spiroidal member has a plurality of longitudinal portions having bottom surfaces for frictionally gripping the floor or ground, said portions each having an attachment to said base member opposed to said bottom surface;

each of said longitudinal portions, upon downward force being exerted by the wearer on the floor or ground and upon a rightward or leftward shear force being exerted on said sole, elastically bending and between said bottom surface and said attachment in a direction opposite said shear force to provide a braking and antiskidding action.

10. A sole for a shoe comprising:

a base member having a main lower surface;

a plurality of contacting surfaces attached to said base member, said contacting surfaces extending downwardly from said base member to below said main lower surface and being disposed to contact the ground or floor before said main lower surface makes contact as the shoe descends;

each said contact surface including an elongate spiroidal element having a plurality of involutions extending downwardly from said base member to below said main lower surface, each involution of the spiroidal element having four discretely oriented portions joined end to end and facing frontward, rearward, rightward and leftward, each of said frontward, rearward, rightward and leftward portions being spaced from and aligned with the remaining frontward, rearward, rightward and leftward portions, respectively, none of said portions crossing any other of said portions;

said portions being resiliently flexible and deformable and providing cushioning from impact upon the wearer's foot exerting a downward force on the ground or floor;

each of said portions having a bottom surface for frictionally gripping the floor or ground and having an attachment to said base member opposite said bottom surface;

each of said forward and rearward portions, upon the wearer's foot exerting downward force on the floor or ground and having a frontward or rearward shear force exerted on the sole, elastically bending and stretching between said bottom surface and said attachment in a direction opposite to said shear force to provide a braking, force-absorbing and antiskidding action, each of said rightward and leftward portions behaving lidewise when encountering a leftward or rightward shear force.

11. The sole of claim 10 wherein said elements are formed as integral extensions of said sole.

12. The sole of claim 11 wherein said sole is integrally formed of rubber.

13. The sole of claim 10, wherein each contact surface further includes an endless outer margin having second righward, frontward, rearward and leftward portions, said second portions being spaced from and aligned with like portions of said spiroidal elements;

said outer margin being adapted to make sealing contact with the ground or floor in order to entrap cushioning air, said entrapped air and said portions coacting to cushion the impact of the foot of the wearer upon impact with the ground or floor.

14. The sole of claim 10 wherein the vertical measurement of each said element from the point of its attachment to said base member to its bottom surface exceeds said element's thickness, the spacing between said element and an adjacent aligned element being on the same order of magnitude as said thickness.

15. A sole for an athletic shoe, comprising:

a base member having a main tread forming a main lower surface;

a plantar contact surface integrally formed on said base member beneath and roughly corresponding in horizontal extent to the plantar surface of the wearer's foot;

a heel contact surface integrally formed on said base member beneath and generally corresponding in horizontal extent to the heel surface of the wearer's foot, said heel contact surface including a forward lateral extension to more closely coincide with the heel surface of the wearer's foot;

each contact surface extending downwardly from said base member to below said main lower surface and being disposed to contact the ground or floor before said lower surface makes contact as the shoe descends;

each contact surface including an endless member and a spiroidal member, each member having a width less than said member's depth and being flexibly resilient and elastic;

said endless member defining the outer margin of said contact surface;

said spiroidal member being disposed inwardly of said endless member and having a plurality of involutions, the outermost involution being similar in shape to said endless member, said involutions being uniformly spaced from adjacent involutions;

said members vertically deforming upon the wearer's foot exerting downward force on the ground or floor, said endless member being adapted to make sealing contact with the ground or floor in order to entrap a cushion of air, said air cushion and said members coacting to cushion the foot of the wearer upon impact with the ground or floor;

said members including longitudinal and transverse portions, said transverse portions including, for said heel contact surface, a plurality of inwardly concave rearward portions and, for said plantar contact surface, a plurality of inwardly concave frontward portions, said portions having flat bottom surfaces for frictionally gripping the floor or ground and attachments to said base member; and each of said transverse portions, upon the wearer's foot exerting downward force on the floor or ground and upon a forward or rearward shear force being exerted on the sole, elastically bending and stretching between said bottom surface and said attachment in a direction opposite of said shear force to provide a braking, force-absorbing and antiskidding action, each of said longitudinal portions acting in a similar manner when a leftward or rightward shear force is exerted on the sole.

16. The sole of claim 15 wherein said sole is integrally formed of rubber.

17. The sole of claim 16 wherein said contact surface is a plantar contact surface disposed beneath the plantar surface of the wearer's foot.

* * * * *

UNITED STATES PATENT AND TRADEMARK OFFICE

CERTIFICATE OF CORRECTION

PATENT NO. : 4,624,062

DATED : November 25, 1986

INVENTOR(S) : James C. Autry

It is certified that error appears in the above-identified patent and that said Letters Patent is hereby corrected as shown below:

Col. 6, line 24 (Claim 1, line 4), "inwardly" should be --downwardly--;

lines 39-40 (Claim 1, lines 19-20), "cud-hioning" should be --cus-hioning--;

line 54 (Claim 6, line 1), "inteerally" should be --integrally--.

Col. 7, line 6 (Claim 8, line 13), "discretelv" should be --discretely--.

Signed and Sealed this

Thirty-first Day of March, 1987

*Attest:*

*Attesting Officer*

DONALD J. QUIGG

*Commissioner of Patents and Trademarks*